United States Patent [19]

Poloni et al.

[11] Patent Number: 4,704,889

[45] Date of Patent: Nov. 10, 1987

[54] PROCEDURE AND DEVICE TO FEED A MULTIPLE-FEED STRAIGHTENING MACHINE AUTOMATICALLY DOWNSTREAM OF A COOLING PLATE

[75] Inventors: Alfredo Poloni, Ronchi dei Legionari; Geremia Nonini, Buttrio, both of Italy

[73] Assignee: Danieli & C. Officine Meccanichi SpA, Buttrio, Italy

[21] Appl. No.: 860,333

[22] Filed: May 7, 1986

[30] Foreign Application Priority Data

May 8, 1985 [IT] Italy ..... 83365 A/85

[51] Int. Cl.[4] ..... B21D 3/02; B21D 43/00; B21B 39/04

[52] U.S. Cl. ..... 72/428; 72/251; 72/419

[58] Field of Search ..... 72/95, 99, 251, 256, 72/257, 221, 157–159, 419, 428, 250, 160, 133; 83/444, 449, 447, 448

[56] References Cited

U.S. PATENT DOCUMENTS

| | | | |
|---|---|---|---|
| 2,862,601 | 12/1958 | Littwin et al. | 10/162 R |
| 3,334,724 | 8/1967 | Steward | 10/169 |
| 3,718,062 | 2/1973 | Gilvar | 198/775 |
| 3,737,021 | 6/1973 | Reth et al. | 198/418 |
| 3,739,619 | 6/1973 | Follrath et al. | 72/426 |
| 3,983,772 | 10/1976 | Oldham | 83/444 |
| 4,546,633 | 10/1985 | Brauer et al. | 72/252 |

FOREIGN PATENT DOCUMENTS

| | | | |
|---|---|---|---|
| 1203721 | 10/1965 | Fed. Rep. of Germany | 72/250 |
| 1427107 | 3/1969 | Fed. Rep. of Germany | 72/428 |

*Primary Examiner*—Lowell A. Larson
*Attorney, Agent, or Firm*—Wegner & Bretschneider

[57] ABSTRACT

A procedure for automatically feeding sections from a cooling plate to a straightening machine is disclosed. A number of sections are removed one at a time from the cooling plate and placed side by side on a layer-forming support, in order to form a layer. The layer of sections is then moved into alignment with the straightening machine and fed into the straightening machine while being held parallel to each other at a pre-determined distance apart. A device is also disclosed which includes a unit for removing the sections from the cooling plate and forming a layer, a unit for moving the sections into alignment with the straightening machine, a unit for feeding the sections into the straightening machine while holding the sections parallel and equidistant from each other, and a conveying unit for bringing the sections from the moving unit to the feeding unit.

11 Claims, 3 Drawing Figures

PROCEDURE AND DEVICE TO FEED A MULTIPLE-FEED STRAIGHTENING MACHINE AUTOMATICALLY DOWNSTREAM OF A COOLING PLATE

This invention concerns a procedure to feed a multiple-feed straightening machine automatically downstream of a cooling plate. To be more exact, the invention concerns a procedure to supply a multiple-feed straightening machine automatically with layers of a plurality of rolled sections coming from a cooling plate.

The invention concerns also a device that carries out such procedure.

The invention provides for the formation of a layer of rolled sections spaced equally apart in a desired lay-out. Such layer is first formed immediately downstream of the cooling plate and is then transferred into line with the lead-in unit of the straightening machine.

The layer of aligned sections is then guided to the lead-in unit of the straightening machine in such a way that the alignment and control of such sections are never lost.

Systems to feed straightening machines automatically are known which arrange for the sections to be taken from the cooling plate, for the sections to be moved into line with the lead-in unit of the straightening machine together with he formation of a layer of sections, and for the straightening of the sections.

This type of feed cannot ensure a correct arrangement where a certain number of sections is being processed (multiple-feed straightening). In fact, when the sections have been moved onto the roller conveyor that feeds the straightening machine, it is very hard to obtain their alignment with the lead-in unit of the straightening machine.

DE-A-1,217,747 (Moeller & Neumann) is known and discloses a roller conveyor to feed a straightening machine positioned in line with such conveyor, which is located at the side of a cooling plate and cooperates therewith. A layer of rolled sections is then moved lengthwise onto the roller conveyor, clamped there by shaped jaws and sheared at one end by means of two saws. The layer is then forwarded to the straightening machine. This procedure is slow and complicated and cannot be employed in modern rolling processes.

FR-A-2,203,761 (Morgan) discloses a system for transferring round bars from a cooling plate to collector combs and thence to straightening rolls by means of movable combs supported on a carriage. This system cannot be applied to elements which are not heavy but cannot be employed for the purposes of the invention under examination.

GB-A-2,026,973 (Kocks) discloses a system for the lateral movement of bars from a cooling plate, with a build-up of bars at one end of such plate.

FR-A-1,533,392 (Compagnie des Ateliers et Forge de la Loire) discloses the alignment of rolled stock at the inlet of a cooling plate by means of abutments positioned on a roller conveyor. This serves to deposit segments of one billet which are aligned with each other but are staggered in relation to segments of a different billet which are aligned with each other.

DE-A-2,317,633 (Schloemann-Siemag) discloses the movement of round bars towards straightening rolls by means of a toothed chain.

Other patents exist, such as DE-C-624,692, DE-A-2,111,381, FR-A-871,613 and DE-A-2,054,920, and should be regarded as providing technological background but concern devices which are hardly or not at all pertinent to the present invention.

The invention now under examination proposes to overcome the problem of the automatic feed of sections of any type to a multiple-feed straightening machine located downstream of a cooling plate.

As is known, if the straightening machine is to work properly, it is necessary that the sections to be fed are already spaced apart in accordance with the shaping of the rolls of the multiple-feed straightening machine itself.

In other words, the sections, which can lie in an irregular lay-out on the cooling plate or can be spaced apart otherwise than as required, have to be perfectly spaced apart. Their geometric lay-out has to be controlled; for instance, all the sections have to have their concave side turned downwards or upwards in the case of channel sections or angle irons, or all the sections have to be oriented in another and the same direction in the case of other types of sections. Moreover, the sections have to be strictly parallel to each other and be equally spaced apart.

Such conditions are generally not to be found at the outlet of a cooling plate.

So that the automatic feed of such sections to the straightening machine can be obtained, a device is therefore required which provides for the alignment and pre-arrangement of the sections upstream of the straightening machine itself.

Such device also has to enable the correct positioning of the sections and the guiding of the same to be controlled constantly.

The purposes of the invention are attained using a unit to form layers step by step provided immediately downstream of the cooling plate. Such unit comprises a series of supports able to move step by step and to take one section at a time from the cooling plate and also able to move by a distance enough to provide the desired spacing from the next section taken. All or a portion of such supports may possibly be magnetized.

The result is that, when a layer has been taken which contains a given number of sections, such number being related, of course, to the maximum capacity of the straightening machine, all the sections taken from the cooling plate are strictly equally spaced apart.

The sections which are thus taken are already butted in alignment on the cooling plate. Such butting operation is performed in a known manner and we shall not dwell upon it here.

In the event of special types of sections the invention may arrange that means which orient the sections cooperate with the cooling plate; such means may be employed, for instance, where the sections are positioned at random right-side-up or upside-down on the cooling plate or with a random orientation.

In a preferred embodiment the unit that forms layers comprises two series of supports or carriages able to move step by step crosswise to the sections and equipped with means that align the sections. The lay-out of the support carriages is such that, when one series of carriages is fully forward, the other series is fully retracted, or viceversa.

It is possible in this way to obtain a substantially continuous feed, or else it is possible to obtain a withdrawl of sections from the cooling plate substantially without downtimes.

The support carriages that form layers cooperate with a transfer unit, which has the task of withdrawing the layer of sections formed and suitably arranged on such carriages, and of transferring such layer to a feeder unit which performs the actual feeding of the straightening machine. This feeder unit, in fact, is positioned in line with the straightening machine itself.

In a preferred embodiment the transfer unit consists of a carriage able to move crosswise to the sections and bearing vertically movable supports which withdraw and deposit the sections. Such supports in turn can comprise alignment means, and all or a part of such supports can also be magnetized. Such transfer supports withdraw the sections equally spaced apart and aligned in correspondence with the unit that forms layers, and transfer them laterally and deposit them on the feeder unit.

In a preferred embodiment the feeder unit consists of a conveyor with powered rollers in line with the straightening machine. At least some of such rollers may possibly be magnetized so as to prevent undesired jerking of the sections being fed.

The invention overcomes the problem of providing constant guiding of the sections fed to the straightening machine by including a lead-in unit, which comprises guides, such as stationary channel guides cooperating with specially shaped roller guides, such guides being able to improve the spacing imparted to the layer of sections and to maintain such spacing throughout the whole sliding of the sections from the roller conyeyor line to the straightening machine itself.

In a preferred embodiment the lead-in unit comprises at least one pair of rollers able to move in relation to each other so as to enable the sections to be readily introduced laterally and such rollers to be clamped thereafter on the sections.

In a preferred embodiment at least one of such rollers consists of a series of annular elements to be fitted resiliently to the roller shaft, the purpose being to be able to be adapted to any small variations in the thickness of the sections, for such variations could hinder proper securing of all the sections.

A guide consisting of a multi-channel panel cooperates with such rollers momentarily so as to provide a final spacing of the sections and to guide the sections when they are sliding. Such guide is normally raised so as to permit lateral introduction of the layer of sections.

In a preferred embodiment a specially shaped guide roller is also included immediately upstream of the rollers of the straightening machine and cooperates with the cited pair of rollers of the lead-in unit.

In such preferred embodiment the cooperation, in the direction of sliding of the sections, provided by the multi-channel guide panel, pair of guide rollers and specially shaped guide roller located immediately upstream of the straightening machine obtains a continuous control of the position of the sections fed to the straightening machine. Such sections, therefore, cannot lose their condition of parallelism and of the equal spacing imparted to them.

Likewise, such sections, which move forward strictly butted in alignment, cannot become displaced lengthwise in relation to each other.

This invention is therefore obtained with a procedure to feed sections automatically to a straightening machine located downstream of a cooling plate, such procedure comprising the following steps:

withdrawal of several sections, one at a time, from the cooling plate together with formation of a layer of sections which comprises the sections already in their feed positioning, transfer of the thus obtained layer of sections to the straightening machine, and controlled feed of the sections, the procedure being characterized in that the withdrawal of each single section from the cooling plate takes place by the lateral movement and depositing of such section on a layer-forming support advancing step-by-step in the direction of such lateral movement so as to form a layer, such layer thus formed being then aligned with the straightening machine.

This invention is also embodied with a device for the automatic feed of sections to a straightening machine located downstream of a cooling plate, such device being characterized in that it comprises:

a unit to form layers which lies on the same axis as, and immediately downstream of, the cooling plate, a transfer unit, a feeder unit, and a lead in unit.

We shall now describe a preferred embodiment of the invention as a non-restrictive example with the help of the attached figures, in which.

Figure 1:
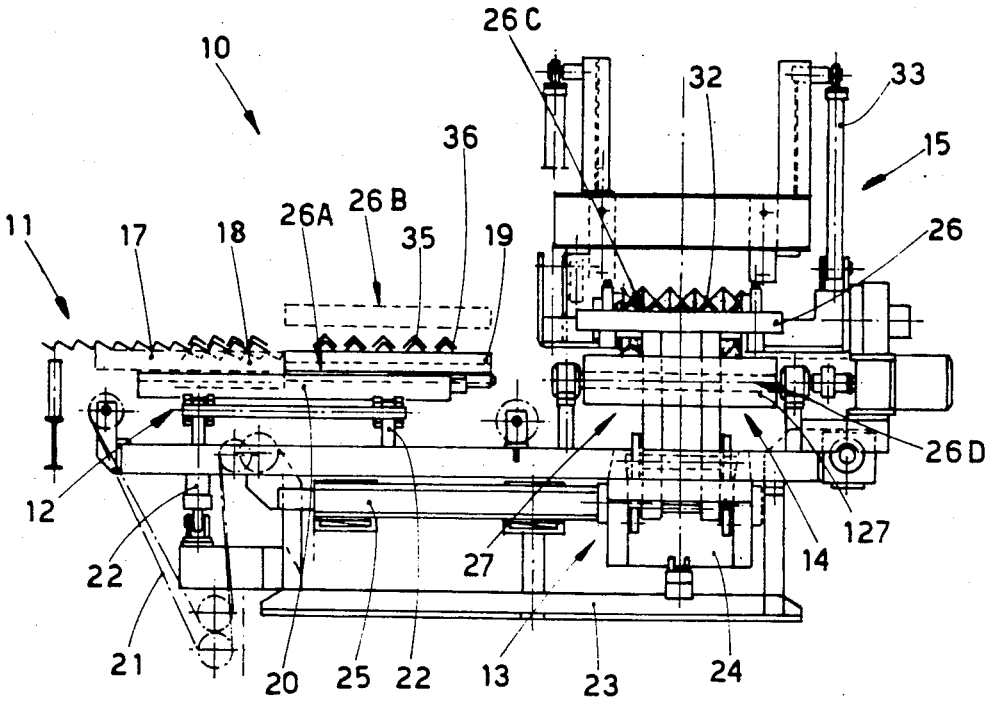
FIG. 1 is a front view of the feeder device of the invention.

In the figures a feed device 10 is located immediately downstream of a cooling plate 11, stationary blades 17 and movable blades 18 of which can be seen. The cooling plate 11 is embodied in a known manner.

A unit 12 which forms layers cooperates with the cooling plate 11 and comprises two series of support carriages 19–119 that form layers. These series of support carriages 19–119 can slide along guides 20 arranged crosswise to rolled sections 35.

Such sections, which have been butted beforehand in a known manner, are moved from the cooling plate 11 to the support carriages 19–119 by the movement of the movable blades 18.

Figure 3:
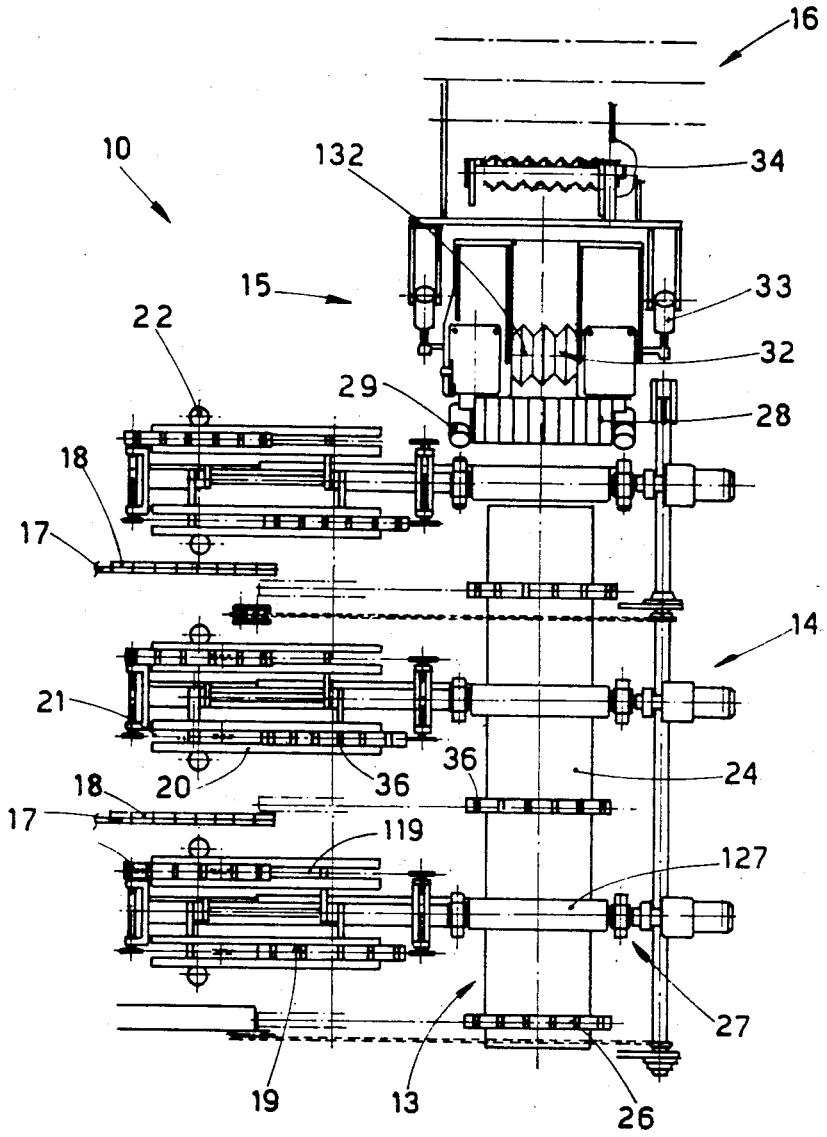
FIG. 3 is a plan view of the device of the invention.

As can be seen in FIG. 3, when one series of support carriages 19 is fully forward, the other series 119 is fully retracted, and viceversa.

The support carriages 19–119 are driven in this example by chains 21, but equivalent actuation means of any type may be provided.

Whenever a section is placed on a support carriage 19–119, that carriage moves forward crosswise to the sections by a distance enough to provide the required space between one section and the next one.

The support carriage 19 therefore moves forward step by step unitl a layer of sections 35 equally spaced apart and aligned according to the required arrangement has been deposited on the support carriage.

FIGS. 1 and 3 show a transfer unit 13, which in this example comprises a carriage 24 able to slide on guides 25 of a frame 23 of the device 10.

Such carriage 24 has the task of moving laterally the layer of sections 35 formed on the support carriages 19–119 up to a position in line with a straightening machine 16.

In this example the carriage 24 comprises a series of transfer supports 26, which can be raised and lowered to withdraw sections 35 from the support carriages 19 and to place them so as to correspond with a feeder unit 14, which in this case consists of a roller conveyor 27 having powered rollers 127.

In the preferred embodiment shown the support carriages 19 or supports 26 comprise means 36 to align the individual sections 35. Such alignment means 36 may be interchangeable to suit the type of section to be processed and the distancing of sections to be applied, or else the whole supports 19–26 may be changed on each occasion, as provided for by the invention.

There will therefore be an appropriate shaping of the supports 19–119 and 26 for each type of section.

The rollers 127 of the roller conveyor 27 may be magnetized or may be shaped in the same manner as the supports 19–119 and 26 so as to maintain the positioned assigned to the sections 35.

According to the invention a lead-in unit 15 is positioned between the roller feeder unit 14 and the straightening machine 16 and has the task of obtaining the final and equally spaced alignment of the sections 35 and also the guiding of such sections in a constant and controlled arrangement to the straightening machine 16. This lead-in unit 15, which can be seen in greater detail in FIG. 2, comprises an upper roller 32 and a lower roller 30.

The height of the lower roller 30 can be adjusted with regulation means 31 of a known type, such as a worm screw or rack or like means, for instance, whereas the upper roller 32 can be raised and lowered by an actuator, which in this example is a jack 33.

In this way the upper roller 32 can be raised or lowered, and also the force with which the pair of rollers 32–30 acts on the sections can be adjusted. The upper roller 32 is normally raised for the lateral introduction of the layer of sections 35.

Figure 2:
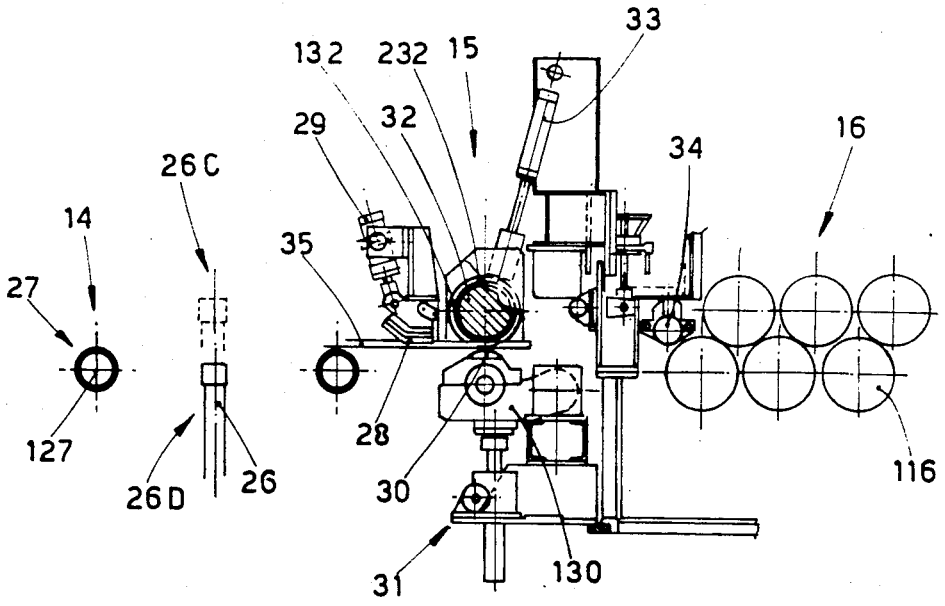
FIG. 2 is a side view of FIG. 1 and shows the lead-in unit in detail.

In the embodiment shown in FIG. 2 the upper roller 32 is formed with a series of annular elements 132 fitted to resilient sleves 232. It is possible in this way to compensate for any small differences in thickness between one section and another and thus to obtain a proper clamping of all the sections engaged and therefore a correct and even feed of such sections.

A series of separator blades 28, or a multiple-channel guide, is comprised immediately upstream of the pair of rollers 30–32 and is actuated by a jack 29 and is normally raised.

When the sections 35 have been inserted between the rollers 30–32, the multiple-channel guide panel 28 is actuated and, by descending, causes the final separation of the sections at the required spacing before they are introduced into the straightening machine 16. The rollers 30–32 can now be clamped by the jacks 33.

A further specially shaped roller 34 can be seen at the end of the lead-in unit 15, the grooves of such shaped roller 34 coinciding with the channels of the multiple-channel guide panel 28.

There is therefore parallel guiding of the sections 35 between the guide panel 28 and end roller 34, and is this way the sections 35 are kept parallel throughout their whole path from the roller conveyor 27 to the lead-in unit 15 of the straightening machine 16.

The device operates in the following manner. The sections 35 on the cooling plate are transferred by the movable blade 18 onto the support carriages 19 or 119, each of such sections being placed on its respective alignment means 36.

Whenever a section is thus placed, the support carriages 19 or 119 move forward by a distance enough to obtain the required spacing between one section and another. Such spacing will be determined to suit the shaping of the grooves of rollers 116 of the straightening machine 16.

FIG. 1 shows actuators 22 which regulate the height at which the support carriages 19–119 lie.

When the formation of a layer of sections 35 has been completed, the carriage 24 is actuated and brought below the layer of sections.

The supports 26 and thus brought to position 26A slightly below the level of such sections, with which the supports 26 therefore do not come into contact.

The supports 26 are then raised to position 26B and take with them the layer of sections, which is then raised and freed from the support carriages 19. The latter 19 can thus return so as to correspond with the cooling plate 11.

The carriage 24 is then traversed sideways, with the supports 26 still raised, until the carriage 24 is aligned with the roller conveyor 27. In this sideways displacement the sections 35 finish their movement with their front end corresponding with the lead-in unit 15 and located between the mutually distanced rollers 30–32. The guide panel 28 is raised and cannot hinder the lateral insertion of the sections.

The supports 26 are at position 26C and are then lowered to position 26D, thus depositing the sections 35 on the rollers 127.

The roller 32 is raised by a distance enough so as not to come into contact with the end of the sections. The multiple-channel guide panel 28 is now lowered by the jack 29.

The final separation and spacing of the sections 35 being fed is caused in this way.

The rollers 30–32 are then clamped in such a way as to hinder sideways displacements of the sections engaged. The rollers 127 and 30–32 are now actuated and cause forward movement of the sections 35.

The sections 35 become engaged in the grooves of the specially shaped roller 34 at the end of the lead-in unit 15.

There is therefore strictly parallel guiding of the sections 35 between the multiple-channel guide panel 28 and shaped roller 34, which is positioned immediately upstream of the rollers 116 of the straightening machine 16. The sections 35 are therefore guided continuously up to the nip point of such rollers 116. Any undesired displacement of the sections 35 being fed is obviated in this way.

I claim:

1. A device to automatically feed sections from a cooling plate to a straightening machine, comprising:

layer-forming means to withdraw a plurality of sections from the cooling plate and deposit them side by side to thereby form a layer, said layer-forming means being co-axial to the cooling plate;

transfer means to bring said layer into alignment with the straightening machine; and feeder means to feed said layer into the straightening machine in a controlled manner, whereby the sections of said layer are kept essentially parallel at a pre-determined distance apart, said feeder means comprising:

at least one pair of feeder rolls into which the sections can be inserted and then clamped, the distance between the centers of each pair of rollers being adjustable, at least one of said feeder rollers consisting of a plurality of elements fitted resiliently together to adapt to the contours of the sections;

a guide panel having multiple channels therein located immediately upstream of the feeder rolls, said guide panel being movable in a vertical direction to thereby clamp the sections at the pre-determined distance apart before they are inserted into the feeder rolls; and spacing means located downstream of the feeder rolls to finally space the sections the pre-determined distance apart;

conveying means to convey said layer from said transfer means to said feeder means.

2. A device as claimed in claim 1, wherein said layer-forming means comprises support carriages to support said sections capable of step-by-step movement which is transverse to the sections, whereby upon each lateral movement, a section is deposited thereon.

3. A device as claimed in claim 2, wherein at least part of the support carriages is magnetized.

4. A device as claimed in claim 3, wherein said transfer means comprises a transfer carriage able to move in a direction transverse to the sections.

5. A device as claimed in claim 4, wherein said transfer carriage comprises transfer supports capable of vertical movement.

6. A device as claimed in claim 5, wherein said transfer supports have a lower position which is lower than the position at which said layer is formed on said layer forming apparatus.

7. A device as claimed in claim 5, wherein at least part of said transfer supports is magnetized.

8. A device as claimed in claim 1, wherein said conveying means comprises a roller conveyor with powered rollers, which is aligned with the straightening machine.

9. A device as claimed in claim 8, wherein at least part of the powered rollers is magnetized.

10. A device as claimed in claim 1, wherein said layer-forming means comprises alignment means.

11. A device as claimed in claim 1, wherein said transfer means comprises alignment means.

* * * * *

UNITED STATES PATENT AND TRADEMARK OFFICE

CERTIFICATE OF CORRECTION

PATENT NO. : 4,704,889

DATED : November 10, 1987

INVENTOR(S) : Alfredo Poloni and Geremia Nonini

It is certified that error appears in the above-identified patent and that said Letters Patent is hereby corrected as shown below:

On the title page

In the Assignee, please change "Danieli & C. Officine Meccanichi" to --Danieli & C. Officine Meccaniche--.

Signed and Sealed this

Twenty-fourth Day of May, 1988

*Attest:*

DONALD J. QUIGG

*Attesting Officer*

*Commissioner of Patents and Trademarks*